US007628302B2

(12) United States Patent
Yau

(10) Patent No.: US 7,628,302 B2
(45) Date of Patent: Dec. 8, 2009

(54) GARMENT HANGER WITH DEPENDENT LOOP AND ACCESSORY HANGER

(76) Inventor: Wai Shing Yau, 179-181, 1/F, Block 2, Yip On Fty. Bldg., Wang Hoi Road, Kowloon Bay, Kowloon (HK)

( * ) Notice: Subject to any disclaimer, the term of this patent is extended or adjusted under 35 U.S.C. 154(b) by 0 days.

(21) Appl. No.: 11/535,586

(22) Filed: Sep. 27, 2006

(65) Prior Publication Data

US 2007/0158375 A1 Jul. 12, 2007

Related U.S. Application Data

(60) Provisional application No. 60/766,351, filed on Jan. 12, 2006.

(51) Int. Cl.
*A41D 27/22* (2006.01)

(52) U.S. Cl. ..... 223/88; 223/85; 223/92; 223/95

(58) Field of Classification Search ..... 223/85, 223/88, 92, 95, 97, DIG. 1, DIG. 4, 91, 87; D6/315, 318, 319, 328
See application file for complete search history.

(56) References Cited

U.S. PATENT DOCUMENTS

| | | | | | |
|---|---|---|---|---|---|
| 924,763 | A | * | 6/1909 | Grant | 223/88 |
| 2,113,394 | A | * | 4/1938 | Biri et al. | 223/88 |
| 2,391,661 | A | * | 12/1945 | Watkins et al. | 223/88 |
| 2,634,032 | A | * | 4/1953 | Bartlett | 223/88 |
| 2,639,844 | A | * | 5/1953 | Udvardy | 223/68 |
| 2,822,967 | A | * | 2/1958 | Spitz | 223/88 |
| D197,542 | S | * | 2/1964 | Levine et al. | D6/319 |
| 3,225,978 | A | * | 12/1965 | Wach | 223/91 |
| 3,946,915 | A | | 3/1976 | Crane | |
| 3,987,898 | A | | 10/1976 | Crane | |
| 3,991,884 | A | | 11/1976 | DeMaagd et al. | |
| 4,007,861 | A | | 2/1977 | Duester et al. | |
| 4,017,990 | A | | 4/1977 | Garrison | |
| 4,023,762 | A | | 5/1977 | Batts et al. | |
| 4,034,865 | A | | 7/1977 | Batts et al. | |
| 4,034,903 | A | | 7/1977 | Batts | |
| D245,748 | S | * | 9/1977 | Ostroll | D6/315 |
| 4,046,293 | A | | 9/1977 | Garrison | |
| D246,817 | S | | 1/1978 | Mainetti | |
| 4,071,146 | A | | 1/1978 | Batts | |
| D247,150 | S | | 2/1978 | Duester | |
| 4,073,457 | A | | 2/1978 | Batts et al. | |
| 4,101,059 | A | | 7/1978 | Batts et al. | |
| D249,619 | S | | 9/1978 | Wolff | |
| 4,115,940 | A | | 9/1978 | Phillips | |
| 4,123,864 | A | | 11/1978 | Batts et al. | |
| 4,157,782 | A | | 6/1979 | Mainetti | |
| D253,081 | S | | 10/1979 | Mainetti | |
| 4,177,908 | A | | 12/1979 | Batts et al. | |
| 4,187,967 | A | | 2/1980 | Garrison | |

(Continued)

FOREIGN PATENT DOCUMENTS

| | | | |
|---|---|---|---|
| GB | 2350058 | A * | 11/2000 |

*Primary Examiner*—Gary L Welch
*Assistant Examiner*—Nathan E Durham
(74) *Attorney, Agent, or Firm*—Baker & McKenzie LLP

(57) ABSTRACT

A hanger having a dependent loop is described. The dependent loop permits an associated hanger to be attached thereto. An accessory hanger is also described. The accessory hanger includes a securing mechanism for attachment to the dependent loop.

20 Claims, 9 Drawing Sheets

U.S. PATENT DOCUMENTS

| | | | | | |
|---|---|---|---|---|---|
| 4,192,441 | A | | 3/1980 | Batts | |
| 4,194,274 | A | | 3/1980 | Garrison | |
| 4,198,773 | A | | 4/1980 | Batts et al. | |
| 4,231,500 | A | | 11/1980 | Mainetti | |
| D259,087 | S | | 5/1981 | Mainetti | |
| 4,295,585 | A | | 10/1981 | Garrison | |
| 4,363,430 | A | * | 12/1982 | Radlin | 223/88 |
| D267,920 | S | | 2/1983 | Batts et al. | |
| D267,921 | S | | 2/1983 | Batts | |
| 4,381,599 | A | | 5/1983 | Duester et al. | |
| 4,395,799 | A | | 8/1983 | Batts | |
| 4,416,401 | A | * | 11/1983 | King | 223/88 |
| D271,649 | S | | 12/1983 | Batts et al. | |
| D272,502 | S | | 2/1984 | Batts et al. | |
| D273,072 | S | | 3/1984 | Batts et al. | |
| D273,073 | S | | 3/1984 | Batts et al. | |
| 4,446,996 | A | | 5/1984 | Garrison | |
| 4,450,639 | A | | 5/1984 | Duester | |
| D281,470 | S | | 11/1985 | Batts | |
| 4,556,158 | A | | 12/1985 | Blanchard et al. | |
| 4,565,309 | A | | 1/1986 | Batts et al. | |
| D283,854 | S | | 5/1986 | Marshall | |
| D284,427 | S | | 7/1986 | Bredeweg | |
| 4,600,132 | A | | 7/1986 | Blanchard | |
| D286,584 | S | | 11/1986 | Blanchard | |
| D286,585 | S | | 11/1986 | Blanchard | |
| 4,638,930 | A | | 1/1987 | Blanchard | |
| 4,653,678 | A | * | 3/1987 | Blanchard et al. | 223/85 |
| 4,660,739 | A | | 4/1987 | Dooley et al. | |
| 4,660,750 | A | | 4/1987 | Blanchard | |
| 4,714,156 | A | * | 12/1987 | Kolton et al. | 206/296 |
| 4,718,546 | A | * | 1/1988 | Kolton et al. | 206/296 |
| 4,729,498 | A | | 3/1988 | Blanchard | |
| 4,739,912 | A | | 4/1988 | Klawieter et al. | |
| 4,744,496 | A | | 5/1988 | Blanchard et al. | |
| 4,746,039 | A | | 5/1988 | Batts et al. | |
| D296,046 | S | | 6/1988 | Marshall | |
| D296,729 | S | | 7/1988 | Blanchard | |
| 4,759,480 | A | | 7/1988 | Duester et al. | |
| D297,286 | S | | 8/1988 | Blanchard | |
| 4,762,238 | A | | 8/1988 | Blanchard | |
| D298,387 | S | | 11/1988 | Duester | |
| D298,783 | S | | 12/1988 | Blanchard | |
| D299,086 | S | | 12/1988 | Wilson | |
| 4,793,531 | A | | 12/1988 | Blanchard et al. | |
| D299,593 | S | | 1/1989 | Blanchard | |
| 4,807,334 | A | | 2/1989 | Blanchard | |
| 4,826,056 | A | | 5/1989 | Duester et al. | |
| D301,661 | S | | 6/1989 | Wilson | |
| D301,806 | S | | 6/1989 | Wilson | |
| D301,808 | S | | 6/1989 | Marshall | |
| D301,942 | S | | 7/1989 | Talbot-Titley | |
| D301,943 | S | | 7/1989 | Wilson | |
| D302,214 | S | | 7/1989 | Wilson | |
| D303,324 | S | | 9/1989 | Wilson | |
| D303,325 | S | | 9/1989 | Marshall | |
| 4,871,097 | A | | 10/1989 | Blanchard et al. | |
| 4,871,098 | A | * | 10/1989 | Bredeweg et al. | 223/85 |
| 4,881,836 | A | | 11/1989 | Blanchard | |
| 4,884,727 | A | | 12/1989 | Blanchard | |
| 4,886,195 | A | | 12/1989 | Blanchard | |
| 4,889,265 | A | | 12/1989 | Morgan | |
| 4,892,237 | A | | 1/1990 | Duester et al. | |
| D305,834 | S | | 2/1990 | DeVito | |
| D305,835 | S | | 2/1990 | DeVito | |
| 4,901,894 | A | | 2/1990 | Blanchard | |
| D307,982 | S | | 5/1990 | Duester | |
| 4,932,571 | A | | 6/1990 | Blanchard | |
| 4,940,244 | A | | 7/1990 | Batts, III | |
| 4,967,500 | A | | 11/1990 | Bredeweg | |
| D316,334 | S | | 4/1991 | Duester | |
| 5,020,705 | A | | 6/1991 | Garrison | |
| 5,022,571 | A | | 6/1991 | Blanchard | |
| 5,029,739 | A | | 7/1991 | Blanchard et al. | |
| 5,052,600 | A | | 10/1991 | Elchisak et al. | |
| 5,054,666 | A | | 10/1991 | Blanchard | |
| 5,056,248 | A | | 10/1991 | Blanchard | |
| 5,069,373 | A | | 12/1991 | Kolton et al. | |
| 5,071,045 | A | | 12/1991 | Hollis | |
| 5,074,447 | A | | 12/1991 | Kolton et al. | |
| 5,082,153 | A | | 1/1992 | Duester et al. | |
| D323,749 | S | | 2/1992 | Blanchard et al. | |
| D324,313 | S | | 3/1992 | Kolton et al. | |
| D324,459 | S | | 3/1992 | Gouldson et al. | |
| 5,092,502 | A | | 3/1992 | Kolton et al. | |
| 5,096,101 | A | | 3/1992 | Norman et al. | |
| D325,822 | S | | 5/1992 | Hollis | |
| D328,194 | S | | 7/1992 | Garrison | |
| 5,129,557 | A | | 7/1992 | Kolton et al. | |
| 5,135,141 | A | | 8/1992 | Harmer et al. | |
| 5,137,191 | A | | 8/1992 | Blanchard et al. | |
| D329,754 | S | | 9/1992 | Gouldson et al. | |
| D329,755 | S | | 9/1992 | Gouldson | |
| 5,155,881 | A | | 10/1992 | Lafferty | |
| D331,869 | S | | 12/1992 | Batts et al. | |
| 5,170,916 | A | | 12/1992 | Kolton et al. | |
| D332,180 | S | | 1/1993 | Marshall et al. | |
| D332,233 | S | | 1/1993 | Batts | |
| 5,183,191 | A | | 2/1993 | Garrison et al. | |
| D334,096 | S | | 3/1993 | Blanchard | |
| D334,846 | S | | 4/1993 | Blanchard | |
| D335,581 | S | | 5/1993 | Gouldson | |
| 5,212,854 | A | | 5/1993 | Hollis | |
| D337,893 | S | | 8/1993 | Norman | |
| D340,138 | S | | 10/1993 | Gouldson | |
| D341,947 | S | | 12/1993 | Marshall et al. | |
| 5,272,806 | A | | 12/1993 | Marshall et al. | |
| 5,285,566 | A | | 2/1994 | Marshall et al. | |
| 5,306,055 | A | | 4/1994 | Mainetti | |
| D348,987 | S | | 7/1994 | Gouldson et al. | |
| D350,236 | S | | 9/1994 | Gouldson et al. | |
| 5,350,092 | A | | 9/1994 | Hollis | |
| D352,834 | S | | 11/1994 | Norman | |
| 5,361,948 | A | | 11/1994 | Batts | |
| 5,388,354 | A | | 2/1995 | Marshall et al. | |
| 5,398,854 | A | | 3/1995 | Blanchard | |
| 5,400,932 | A | | 3/1995 | Hollis | |
| 5,411,189 | A | | 5/1995 | Gouldson | |
| D358,942 | S | | 6/1995 | Blanchard et al. | |
| 5,421,494 | A | * | 6/1995 | Kolton et al. | 223/85 |
| 5,441,182 | A | | 8/1995 | Sullivan | |
| 5,449,099 | A | | 9/1995 | Blanchard | |
| 5,469,995 | A | | 11/1995 | Bredeweg et al. | |
| 5,477,995 | A | | 12/1995 | Dooley et al. | |
| 5,480,075 | A | * | 1/1996 | Robinson | 223/88 |
| D368,376 | S | | 4/1996 | Gouldson et al. | |
| 5,507,086 | A | | 4/1996 | Marshall et al. | |
| 5,509,587 | A | | 4/1996 | Gouldson et al. | |
| 5,516,013 | A | | 5/1996 | Gouldson et al. | |
| 5,516,014 | A | | 5/1996 | Garrison | |
| 5,524,801 | A | | 6/1996 | Dooley et al. | |
| D371,246 | S | | 7/1996 | Gouldson et al. | |
| 5,535,927 | A | | 7/1996 | Garrison | |
| 5,558,280 | A | | 9/1996 | Morgan | |
| 5,568,685 | A | | 10/1996 | Marshall et al. | |
| D375,208 | S | | 11/1996 | Gouldson | |
| 5,577,644 | A | * | 11/1996 | Chen | 223/85 |
| D376,263 | S | | 12/1996 | Gouldson | |
| 5,584,421 | A | | 12/1996 | Blanchard et al. | |
| D377,717 | S | | 2/1997 | Gouldson | |
| 5,604,975 | A | | 2/1997 | Marshall et al. | |
| 5,613,630 | A | | 3/1997 | Isenga et al. | |
| 5,628,132 | A | | 5/1997 | Marshall et al. | |
| 5,645,200 | A | * | 7/1997 | McDowell et al. | 223/89 |

5,649,651 A * 7/1997 Lam ..... 223/85
5,683,018 A 11/1997 Sullivan et al.
D388,620 S 1/1998 Gouldson et al.
D388,964 S 1/1998 Gouldson
D390,015 S 2/1998 Gouldson
D392,113 S 3/1998 Gouldson
D394,753 S * 6/1998 Zuckerman ..... D6/328
D394,754 S 6/1998 Gouldson
5,758,806 A * 6/1998 Anderson ..... 223/92
D396,353 S 7/1998 Gouldson
5,775,553 A 7/1998 Marshall et al.
5,775,575 A 7/1998 Dorman et al.
5,785,216 A 7/1998 Gouldson et al.
5,785,260 A 7/1998 Morgan
5,794,363 A 8/1998 Marshall et al.
5,803,321 A * 9/1998 Willinger et al. ..... 223/88
5,814,252 A 9/1998 Gouldson et al.
D400,718 S 11/1998 Bortolus
5,857,276 A 1/1999 Marshall et al.
D405,964 S 2/1999 Willinger
5,884,422 A 3/1999 Marshall et al.
5,894,923 A 4/1999 Hamstra et al.
D409,006 S 5/1999 Blanchard
D409,400 S 5/1999 Peruzzo
D409,846 S 5/1999 Blanchard
D410,793 S 6/1999 Gouldson
5,915,605 A 6/1999 Blanchard
5,934,525 A * 8/1999 Blanchard ..... 223/96
5,944,237 A 8/1999 Gouldson
D413,446 S 9/1999 Gouldson
D414,044 S 9/1999 Choi et al.
5,950,885 A 9/1999 Morgan
D414,946 S 10/1999 Gouldson
D415,357 S 10/1999 Blanchard
5,992,714 A 11/1999 Morgan
5,996,862 A 12/1999 Peruzzo et al.
D418,311 S 1/2000 Gouldson
6,019,260 A 2/2000 Gouldson
6,019,261 A 2/2000 Morgan et al.
6,023,819 A 2/2000 Wong et al.
6,029,868 A 2/2000 Willinger et al.
6,041,983 A 3/2000 Sullivan et al.
6,041,984 A 3/2000 Gouldson
D423,234 S 4/2000 Gouldson
6,050,461 A 4/2000 Batts et al.
6,055,350 A 4/2000 Brown et al.
D423,797 S 5/2000 Gouldson
D424,817 S 5/2000 Morgan et al.
6,070,772 A * 6/2000 Bond ..... 223/85
6,076,863 A 6/2000 Platt Brown et al.
6,085,950 A 7/2000 Gouldson et al.
D429,898 S 8/2000 Morgan et al.
6,098,254 A 8/2000 Willinger
6,105,834 A * 8/2000 Cohen ..... 223/88
6,105,836 A 8/2000 Batts et al.
RE36,873 E 9/2000 Gouldson et al.
6,128,932 A 10/2000 Mainetti et al.
D435,173 S 12/2000 Morgan et al.
6,158,635 A 12/2000 Batts
D435,973 S 1/2001 Gouldson
D436,743 S 1/2001 Batts et al.
6,173,872 B1 1/2001 Cohen
6,189,746 B1 2/2001 Gouldson
6,196,430 B1 3/2001 Gouldson
6,199,728 B1 3/2001 Cohen
D439,751 S 4/2001 Gouldson
D440,409 S 4/2001 Blanchard
D440,410 S 4/2001 Gouldson
6,209,763 B1 * 4/2001 Rahmey ..... 223/88
D441,550 S 5/2001 Gouldson
D441,551 S * 5/2001 Yegavian et al. ..... D6/328
6,241,133 B1 6/2001 Morgan et al.
6,260,745 B1 7/2001 Gouldson et al.
6,264,075 B1 7/2001 Gouldson et al.
D447,878 S 9/2001 Hawkins
6,289,569 B1 9/2001 Marshall et al.
D449,743 S 10/2001 Morgan
6,299,039 B1 * 10/2001 Hsu ..... 223/85
6,305,586 B1 10/2001 Wong
6,306,329 B1 10/2001 Willinger
6,308,872 B1 * 10/2001 Duerr et al. ..... 223/88
D450,463 S 11/2001 Wong et al.
D450,464 S * 11/2001 Olk et al. ..... D6/328
D451,291 S 12/2001 Hawkins
D453,423 S 2/2002 Goldman et al.
D454,006 S 3/2002 Gouldson
D454,435 S 3/2002 Willinger
6,357,638 B2 3/2002 Gouldson
6,378,744 B2 4/2002 Olk et al.
6,382,478 B2 5/2002 Gouldson et al.
D458,039 S 6/2002 Gouldson
D459,593 S 7/2002 Gouldson
6,421,910 B1 7/2002 Marshall et al.
6,422,437 B2 7/2002 Gouldson et al.
6,422,438 B1 7/2002 Batts
6,435,387 B1 8/2002 Gouldson et al.
D463,918 S 10/2002 Goldman et al.
6,467,658 B1 * 10/2002 Olk et al. ..... 223/88
6,467,659 B2 10/2002 Gouldson
6,474,517 B1 11/2002 Sutton
6,484,390 B1 11/2002 Gouldson et al.
D466,311 S 12/2002 Hawkins
D466,704 S 12/2002 Hawkins
D466,705 S 12/2002 Hawkins
6,499,633 B1 12/2002 Pogmore
6,499,634 B2 12/2002 Olk et al.
D469,964 S 2/2003 Gouldson
6,516,980 B1 2/2003 Goldman
6,523,240 B1 2/2003 Gouldson
D472,393 S * 4/2003 Louw ..... D6/328
D472,394 S 4/2003 Hawkins
6,564,980 B2 5/2003 Gouldson et al.
6,588,634 B2 7/2003 Gouldson et al.
6,609,640 B1 8/2003 Bokmiller
6,609,641 B2 8/2003 Sutton
6,612,000 B2 9/2003 Housley
6,675,997 B1 1/2004 Gouldson et al.
6,681,966 B2 1/2004 Gouldson et al.
6,688,502 B2 * 2/2004 Kunreuther ..... 223/85
6,705,496 B2 3/2004 Marshall et al.
6,711,808 B2 3/2004 Sollanek et al.
6,715,650 B2 4/2004 Gouldson
6,743,323 B2 6/2004 Mainetti
6,758,378 B2 * 7/2004 Carmichael ..... 223/85
6,758,379 B1 * 7/2004 Elwell ..... 223/85
6,772,923 B2 8/2004 Olk et al.
D498,597 S * 11/2004 Ortega ..... D6/319
D498,935 S 11/2004 Gouldson
D498,936 S 11/2004 Gouldson
D500,412 S 1/2005 Gouldson
D501,092 S 1/2005 Mainetti
D502,009 S 2/2005 Gouldson
D502,011 S 2/2005 Gouldson
D502,328 S 3/2005 Gouldson
D502,606 S 3/2005 Gouldson
D502,651 S 3/2005 Gouldson
D503,287 S 3/2005 Gouldson
6,865,832 B1 3/2005 Goldman
6,871,765 B2 3/2005 Mainetti
D504,024 S 4/2005 Malnetti
6,874,666 B2 4/2005 Gouldson et al.
6,875,392 B2 * 4/2005 Olk et al. ..... 264/318
6,892,910 B2 5/2005 Capuano et al.
D506,077 S 6/2005 Pluchino et al.
D506,320 S 6/2005 Gouldson
D506,619 S 6/2005 Mainetti D507,418 S 7/2005 Mainetti
D507,419 S 7/2005 Gouldson
6,915,931 B2 7/2005 Gouldson et al.
6,923,350 B2 8/2005 Gouldson et al.
6,926,180 B2 8/2005 Mainetti
D511,049 S 11/2005 Gouldson
D512,571 S 12/2005 Gouldson et al.
D515,320 S 2/2006 Sutton et al.
D515,321 S 2/2006 Sutton et al.
D515,322 S 2/2006 Sutton et al.
D515,829 S 2/2006 Sutton et al.
D517,818 S 3/2006 Sutton et al.
D530,526 S * 10/2006 Yau ..... D6/328
D531,824 S * 11/2006 Yau ..... D6/328
7,182,232 B2 * 2/2007 Fleming et al. ..... 223/88
2001/0011663 A1 8/2001 Olk et al.
2001/0016994 A1 8/2001 Gouldson et al.
2001/0019070 A1 9/2001 Gouldson et al.
2002/0056734 A1 5/2002 Olk et al.
2002/0070251 A1 6/2002 Gouldson et al.
2002/0190090 A1 12/2002 Gouldson et al.
2003/0052142 A1 * 3/2003 Olk et al. ..... 223/88
2003/0126725 A1 7/2003 Housley
2003/0136804 A1 7/2003 Gouldson et al.
2003/0154594 A1 8/2003 Sollanek et al.
2003/0183665 A1 10/2003 Olk et al.
2003/0209577 A1 11/2003 Gouldson et al.
2004/0004096 A1 1/2004 Gouldson et al.
2004/0007603 A1 * 1/2004 Kunreuther ..... 223/85
2004/0159686 A1 * 8/2004 Huang ..... 223/85
2004/0163239 A1 8/2004 Sollanek et al.
2004/0182891 A1 9/2004 Mainetti
2004/0188475 A1 * 9/2004 Gouldson ..... 223/85
2004/0200865 A1 10/2004 Mainetti
2004/0206788 A1 10/2004 Capuano et al.
2004/0222252 A1 11/2004 Gouldson et al.
2004/0222254 A1 11/2004 Olk et al.
2005/0067445 A1 3/2005 De Groot
2005/0139625 A1 6/2005 Gouldson
2005/0184108 A1 * 8/2005 Ho et al. ..... 223/85
2005/0194412 A1 9/2005 Petrou
2005/0284899 A1 * 12/2005 Fleming et al. ..... 223/85
2006/0186149 A1 * 8/2006 Wu ..... 223/85
2006/0278671 A1 * 12/2006 Gouldson ..... 223/85

* cited by examiner 150
152
202
206
210
200
204
206

120
100
110
152
150
200

202
152
150
200
204

150
254

110
350
1002
1000

1002
1006
1004
454
456
452
462
458
464
460
1008
1000

462
464
450
460
1004
1006
1008
1000
1002

GARMENT HANGER WITH DEPENDENT LOOP AND ACCESSORY HANGER

CROSS-REFERENCE TO RELATED APPLICATIONS

This application claims priority to U.S. Provisional Application No. 60/766,351, filed Jan. 12, 2006, entitled "Garment Hanger with Dependent Loop and Accessory Hanger," the contents of which are incorporated herein by reference in its entirety.

TECHNICAL FIELD

This disclosure relates to a hanger, and more particularly to a garment hanger with a dependent loop and an accessory hanger that may be mounted on the dependent loop.

BACKGROUND

Numerous types of hangers have been used to hang garments, such as skirts, slacks, and pants. As is known in the art, hangers typically have a cross-member on which to hang the garment, with a hook coupled to the cross-member for hanging the hanger on a rail or other hanging mechanism.

Some hangers have employed a loop structure on the underside of the cross-member through which another hook may be hung to support another hanging garment. However, these hangers do not have a mechanism that can fixedly secure the added hanger at a stationary position. Rather, the added hanger can rotate freely within the loop.

Some loop hangers use a "coordinated loop" structure to keep the added hanger in a position that is relatively parallel to the top hanger. Exemplary hangers in this respect are shown in U.S. Pat. No. 4,871,098. However, even in this "coordinated loop" design, the additional hanger is loosely attached to the loop hanger, and can be rotated freely when a force is applied to it.

There is a need for a hanger that can be attached to another hanger, while maintaining the position of the additional hanger at a secured position.

BRIEF SUMMARY

A hanger having a dependent loop is provided. The dependent loop may allow an additional hook and associated hanger to be hung therefrom, or an accessory hanger to be attached thereto. The accessory hanger may be secured to the dependent loop by a securing mechanism.

BRIEF DESCRIPTION OF THE DRAWINGS

For a more complete understanding of the principles disclosed herein, and the advantages thereof, reference is now made to the following descriptions taken in conjunction with the accompanying drawings in which.

DETAILED DESCRIPTION

Figure 1:
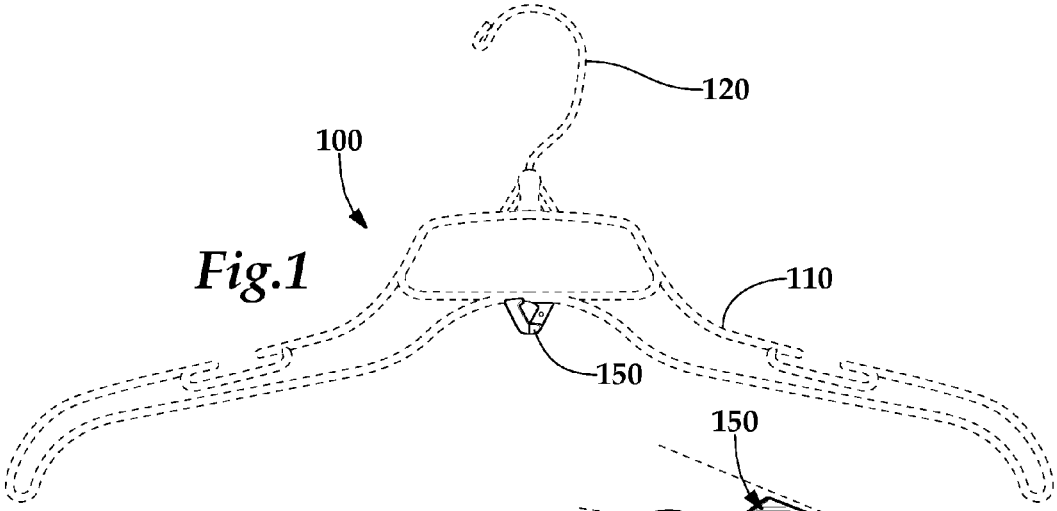
FIG. 1 is an elevational view of a hanger with dependent loop in accordance with the present disclosure.
Figure 2:
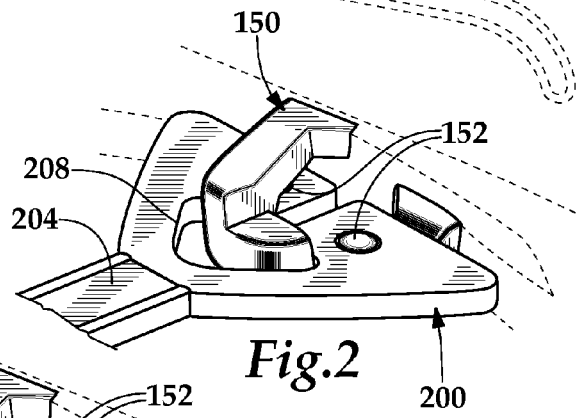
FIG. 2 is a perspective view of the dependent loop with an exemplary accessory hanger attached in accordance with the present disclosure.
Figure 3:
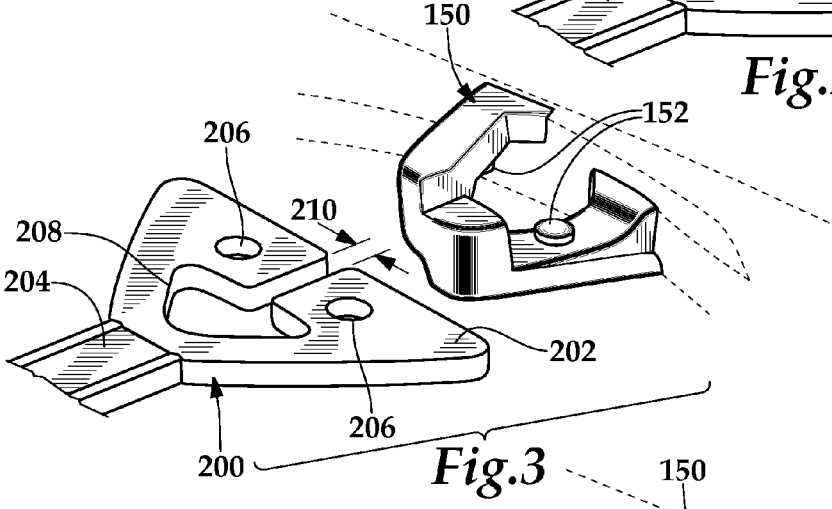
FIG. 3 and 3A are exemplary embodiments of the dependent loop and the accessory hanger.

Referring now to FIG. 1, illustrated is an elevational view of a hanger 100 with dependent loop 150. As used herein, the term "loop" refers to any interconnected structure without regard to specific shapes, sizes or configurations. Hanger 100 is capable of holding pants, skirts, shorts, and other garments or articles. Hanger 100 includes a cross member 110 and a hook member 120 of conventional configuration for hanging on a rail. The cross member 110 may be of I-Beam construction, or any such similar structure providing rigidity. The cross member may be made using vacuum molding or injection molding techniques and may be made of translucent or colored, plastic material. Dependent loop 150 is integrally molded to the cross member, and is typically located in the center of gravity of the hanger 100, for example, on the underside of the hanger, aligned with the hook. Of course, the dependent loop 150 may be connected to the cross member in other suitable manners such as detachable connections. FIG. 2 illustrates a perspective view of a portion of an accessory hanger 200 coupled to dependent loop 150, whereas FIG. 3 shows a perspective view of the dependent loop 150 and the accessory hanger 200 separated from each other.

Figure 3A:
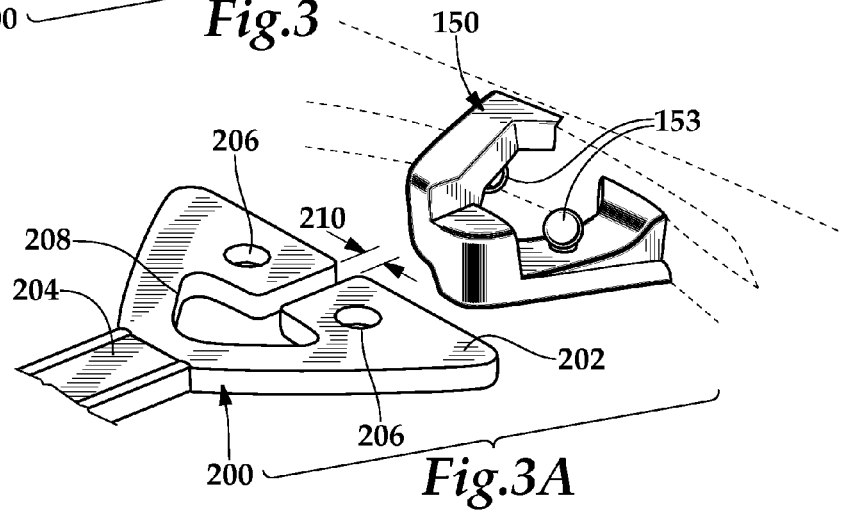

The dependent loop 150 includes nodules 152, which are disposed on the inside vertical surfaces of the dependent loop 150. Nodules 152 provide a securing mechanism to securely fasten accessory hanger 200 to the dependent loop 150. In the exemplary embodiment illustrated in FIG. 3A, nodule 153 of the dependent loop 150 is a stem with a ball joint mounted at the end. In other embodiments, the nodule 152 may be any other fastening member that may engage with accessory hanger 200. Indeed, the nodule 152 may take the form of a peg, which is designed to pressure fit with a corresponding hole. Other suitable fastening arrangements are contemplated so long as the accessory hanger can be detachably secured to the dependent loop.

The accessory hanger 200 includes an attaching plate 202 integrally molded or otherwise connected to one end of arm 204. The other end of arm 204 is connected to a variety of objects (not shown in FIG. 3) that are operable to hold an accessory garment such as a tie, a pair of gloves, a pair of socks, a pair of shoes, or any other accessory garment.

Figure 15A:
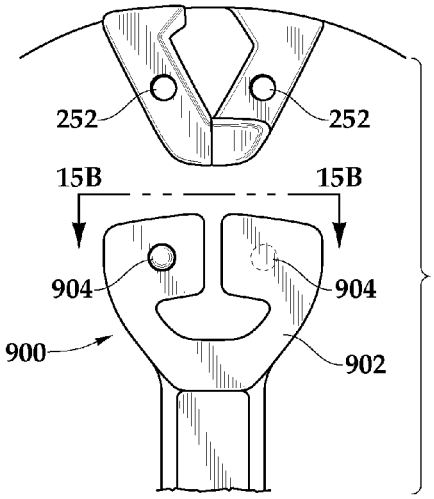
FIG. 15*a* is an elevational view of an accessory hanger separated from a dependent loop according to another embodiment of the present disclosure.
Figure 15B:
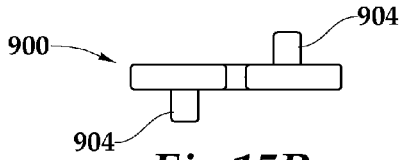
FIG. 15*b* is a top view of the accessory hanger of FIG. 15*a;*

The attaching plate 202 includes holes 206 and an opening 208. The holes 206 provide an opening through which nodules 152 may enter, and be securely fastened thereto. It is to be appreciated that the holes may be replaced with sockets without departing from the scope of this disclosure. Still further, the attaching plate 202 may include the nodules 152 and the dependent loop may include the holes 206 formed therethrough, such as depicted in FIGS. 15*a* and 15*b*. The opening 208 is a gap in the attaching plate 202 that provides sufficient spacing for dependent loop 150. The attaching plate 202 further includes a slot 210 extending from the opening 208. The slot 210 has dimensions that are sufficient to provide clearance to the accessory hanger 200 when attaching it to the dependent loop 150. In some embodiments, the attaching plate 202 is formed of resilient material to permit enlargement of the slot 210 by flexing opposing portions of the attaching plate.

In operation, the accessory hanger 200 may be attached to the dependent loop 150 by inserting the accessory hanger 200 through the lower portion of the dependent loop 150. The accessory hanger may then be rotated toward the nodules 152 and force may be applied to the attaching plate 202 in the appropriate direction to secure nodules 152 to holes 206. As mentioned earlier, nodules 152 and holes 206 may provide a ball and socket combination for securing the accessory hanger 200. Sufficient forces applied in the opposite direction may of course allow the accessory hanger to be released from dependent loop 150.

Figures 4, 5, 6, 7:
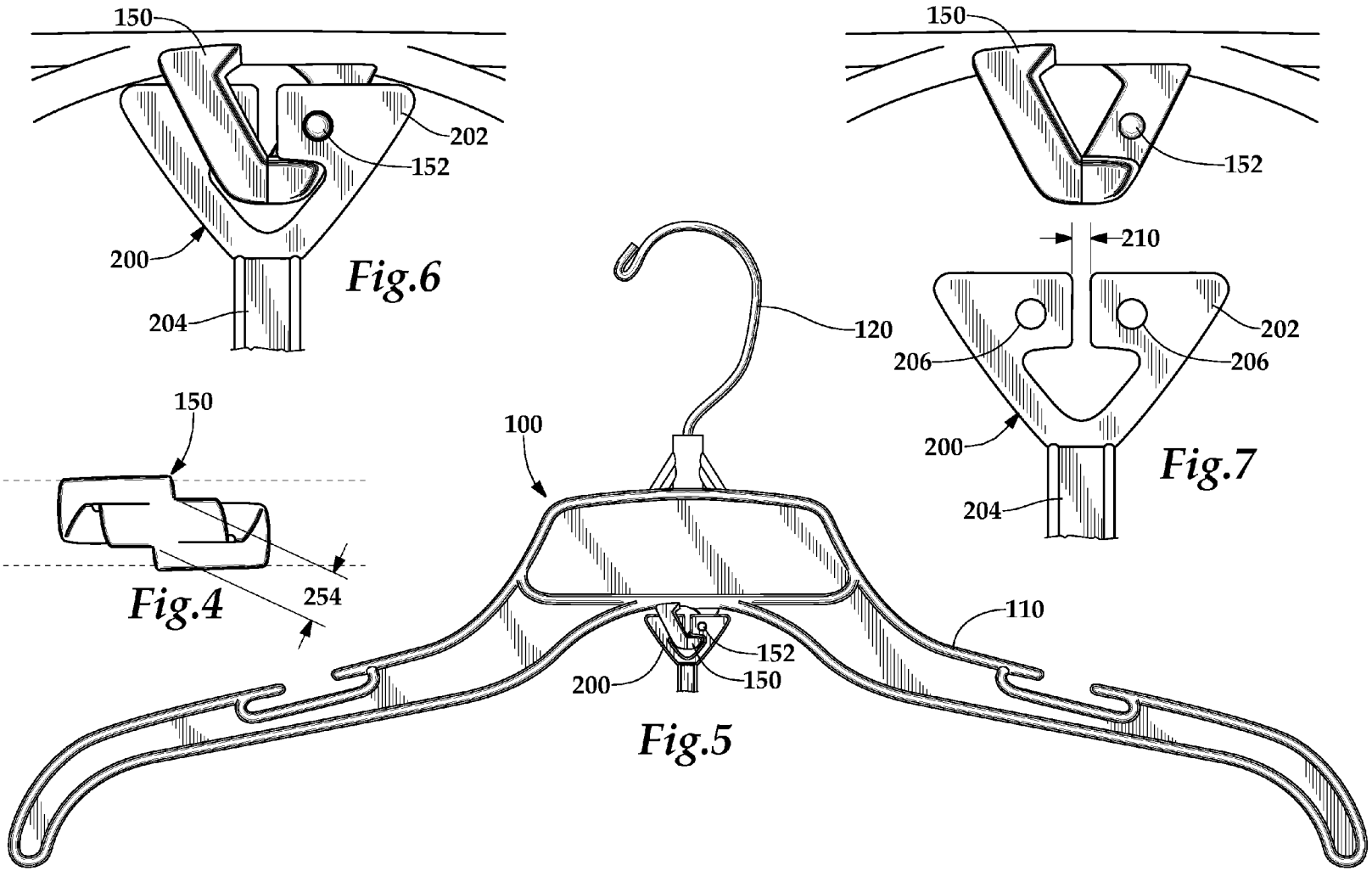
FIG. 4 is a bottom view of the dependent loop.
FIG. 5 is an elevational view of an exemplary hanger, with an accessory hanger secured to a dependent loop in accordance with the present disclosure.
FIG. 6 is an elevational view of the accessory hanger attached to the dependent loop.
FIG. 7 is an elevational view of the accessory hanger separated from the dependent loop.

FIG. 4 shows a bottom view of the dependent loop 150. The lower portion of the dependent loop 150 provides a base from which another hanger may be hung. Thus, the dependent loop 150 provides a multi-functional hanging apparatus which allows for both hanging conventional hangers and hanging accessory hangers, such as the accessory hanger 200. The reference numeral 254 references a diagonal clearing distance for the slot 210 when in the diagonal configuration.

FIG. 5 is an elevational view of the exemplary hanger 100 with accessory hanger 200 (a portion of which is shown) secured thereto via the dependent loop 150. FIGS. 6-7 are detailed elevational views of the accessory hanger 200 attached to the dependent loop 150 (FIG. 6) and the accessory hanger separated from the dependent loop (FIG. 7).

Figure 8A:
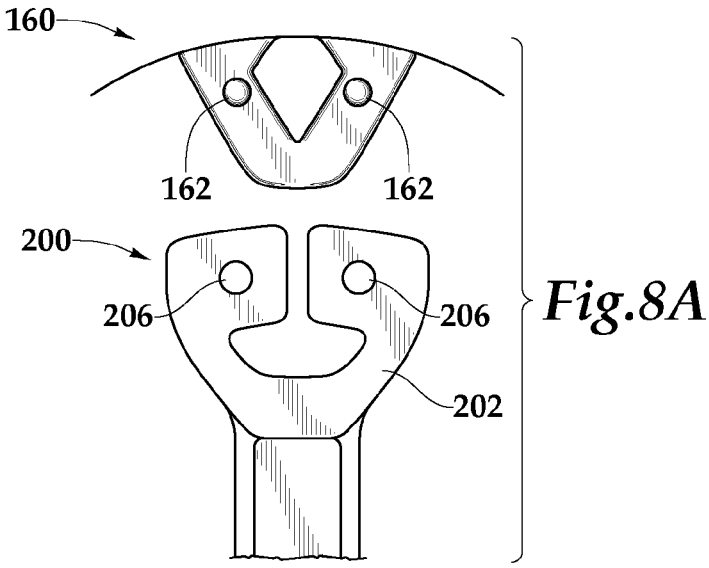
FIG. 8*a* is an elevational view of an accessory hanger separated from a dependent loop according to another embodiment of the present disclosure.
Figure 8B:
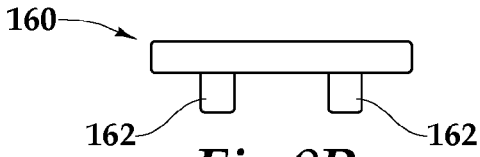
FIG. 8*b* is a top view of the dependent loop shown in FIG. 8*a;*

FIG. 8*a* illustrates another exemplary dependent loop 160, which includes nodules 162 disposed on the same vertical surface. In operation, the accessory hanger 200 may be snap fit onto the dependent loop 160 by aligning the holes 206 of the accessory hanger with the nodules 162 and applying pressure to the attaching plate 202 to engage the nodules with the holes. FIG. 8*b* illustrates a top view of the dependent loop 160.

Figure 9:
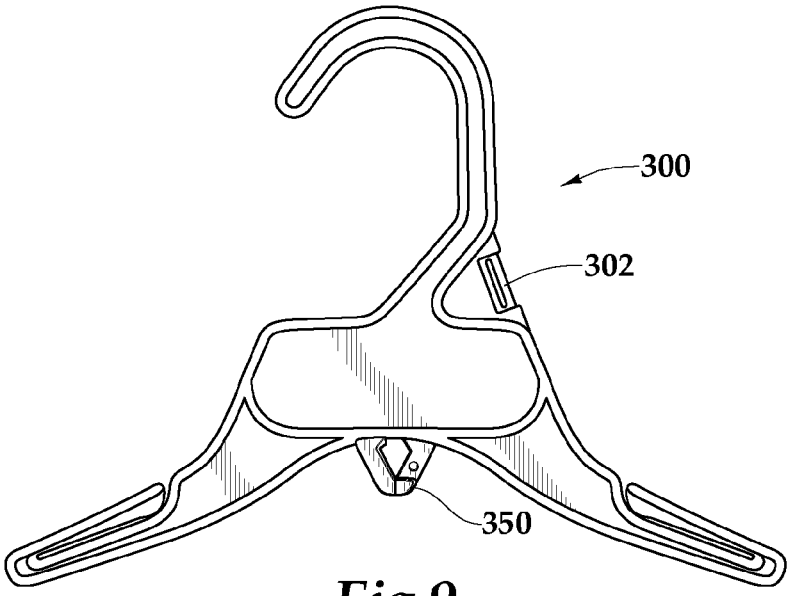
FIG. 9 is an elevational view of a garment hanger having an information mount and a dependent loop in accordance with the present disclosure.

It should be appreciated that the present disclosure can be applied to a wide variety of garment hangers. For example, the present disclosure can be implemented with a single garment hanger as shown in FIG. 5, or it can also be implemented with a garment hanger 300 that has been adapted to receive an information tab or clip mounted thereon, as shown in FIG. 9. The garment hanger 300 includes an information tab mount 302 that is operable to receive an information tab and to inhibit removal of the information tab absent some tool or other removing device. The garment hanger 300 further includes the dependent loop 150 as described above.

Figure 10:
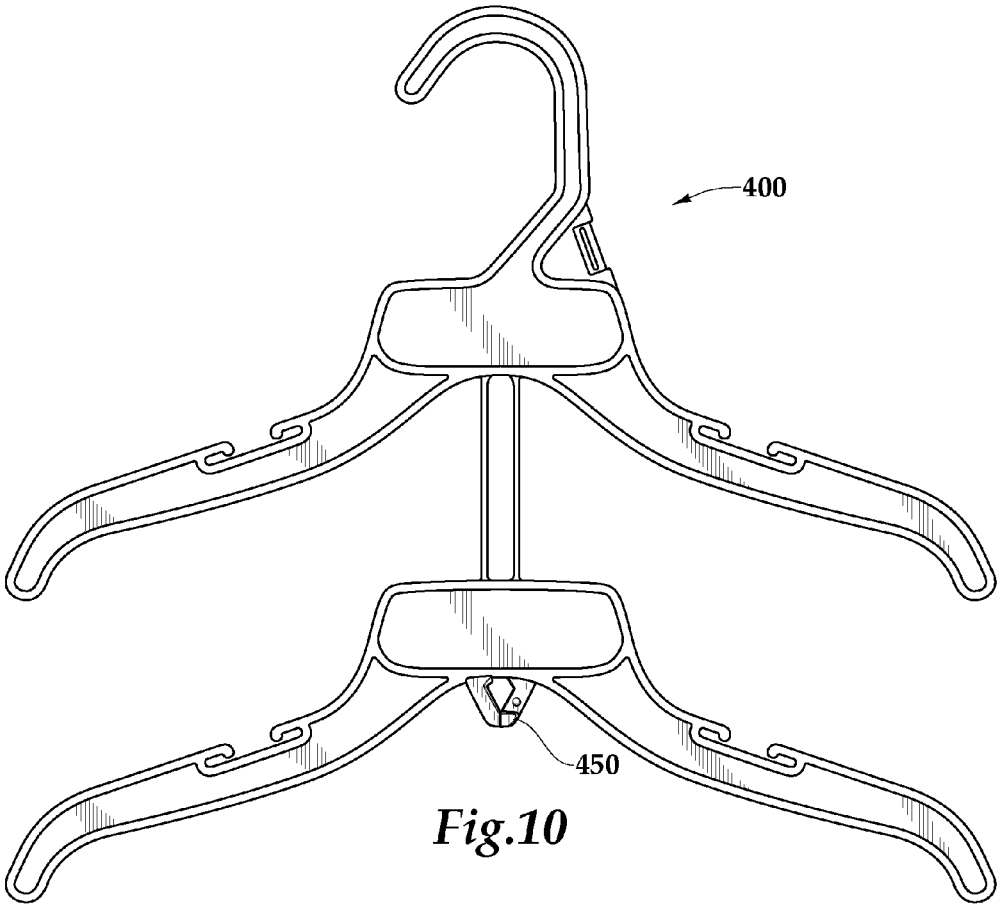
FIG. 10 is an elevational view of a tandem hanger having a dependent loop in accordance with the present disclosure.

In yet another example, the present disclosure can be implemented with a tandem hanger arrangement 400 as shown in FIG. 10 of the application. The tandem hanger 400 also includes the dependent loop 150 as described above.

Figure 11:
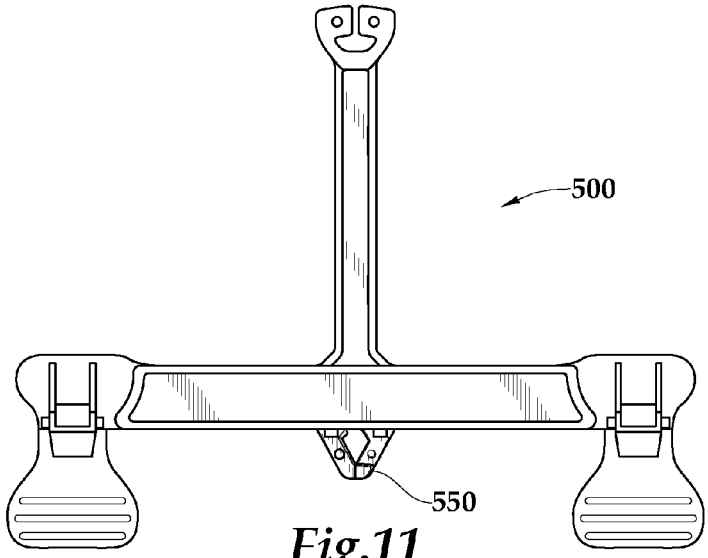
FIG. 11 is an elevational view of a pinch-clip accessory hanger having a dependent loop in accordance with the present disclosure.

It should also be understood that the present disclosure can be applied to a wide variety of accessory hangers. As discussed previously in the present disclosure, one end of arm 204 may be integrally molded or otherwise connected to a variety of objects that are operable to hold an accessory garment. For example, a pinch clip hanger 500 may be mounted or integrally molded to the arm 204 as illustrated in FIG. 11. The pinch clip hanger 500 may also include the dependent loop 150 as described above.

Figure 12:
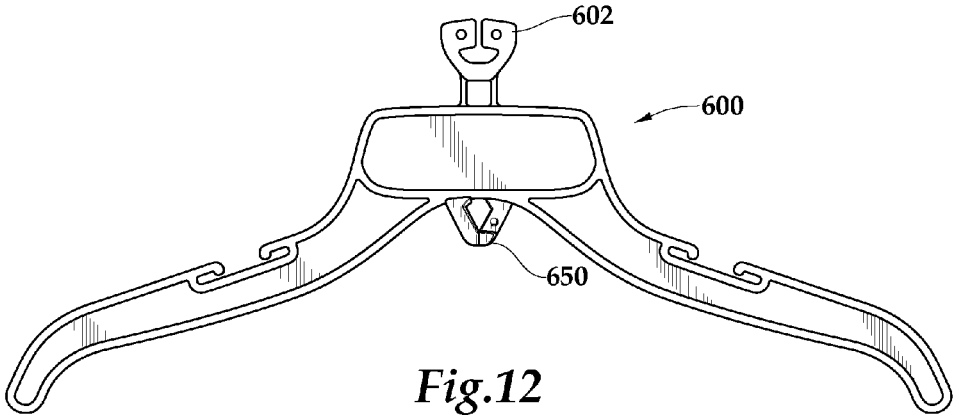
FIG. 12 is an elevational view of an exemplary accessory hanger having a dependent loop in accordance with the present disclosure.
Figure 13:
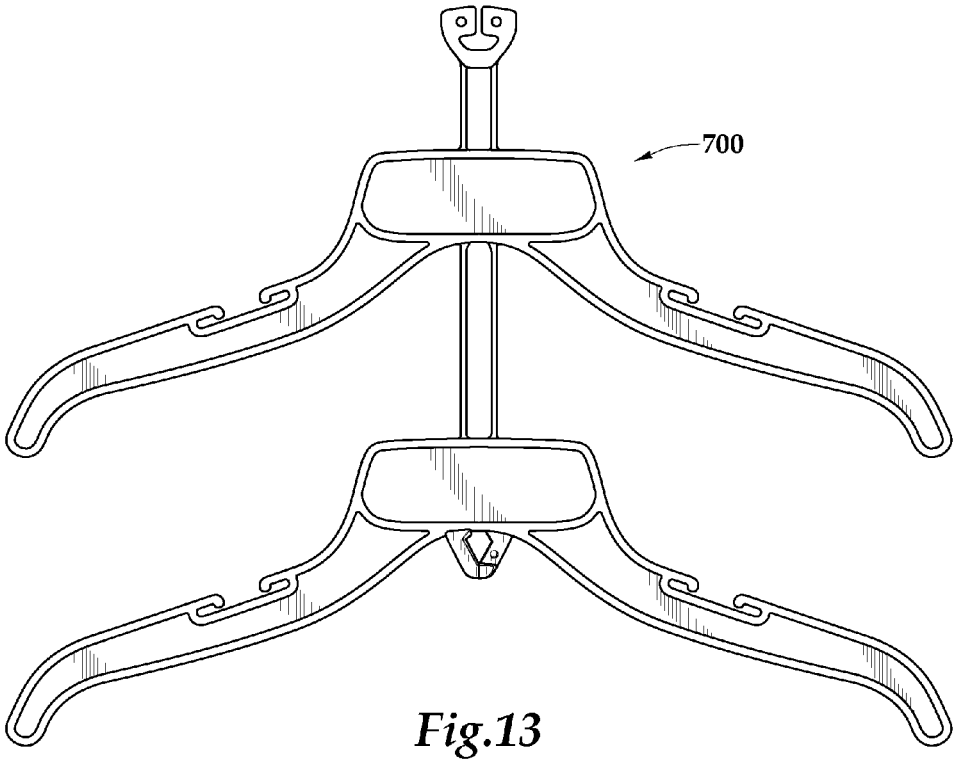
FIG. 13 is an elevational view of a tandem accessory hanger having a dependent loop in accordance with the present disclosure.

FIG. 12 illustrates yet another embodiment of an accessory hanger 600 in accordance with the present disclosure. In this embodiment, attaching plate 202 replaces the hook of a typical garment hanger. Accessory hanger 600 may also have the dependent loop 150 to allow the attachment of an additional accessory hanger. FIG. 13 illustrates a tandem garment hanger converted into a tandem accessory hanger 700 in a similar fashion.

Figure 14A:
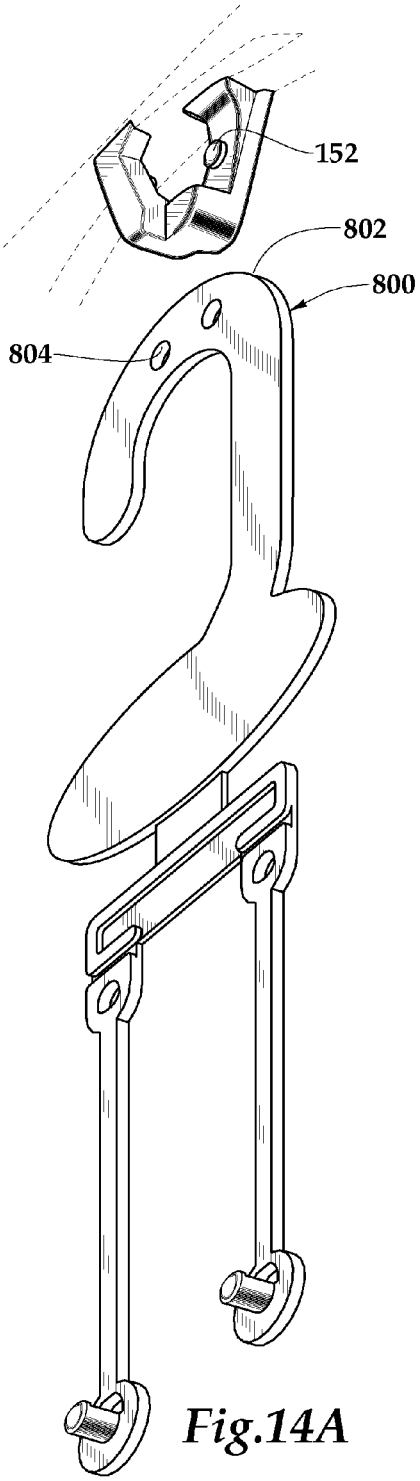
FIG. 14*a* is a perspective view of another accessory hanger separated from the dependent loop.
Figure 14B:
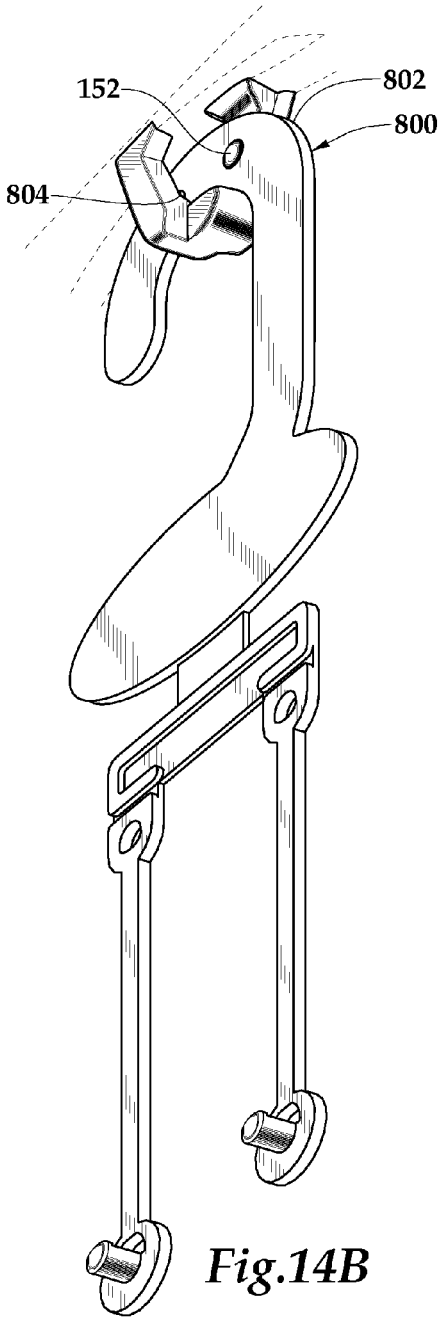
FIG. 14*b* is a perspective view of the accessory hanger of FIG. 14*a* attached to the dependent loop.

FIGS. 14*a* and 14*b* illustrate yet another embodiment of the present disclosure in which an accessory hanger 800 includes a traditional hook portion 802. In this example, the hook portion 802 is substantially semi-circular in shape and includes at least one hole 804 for receiving the nodule 152 in a secured engagement. In practice, the nodule 152 may be snap fit into the hole 804. In another embodiment, two holes may be provided to further effect a secured attachment. It is to be appreciated that other similar arrangements can also be employed without departing from the teachings of the present disclosure.

FIGS. 15*a* and 15*b* illustrate yet another embodiment of the present disclosure in which an accessory hanger 900 includes an attachment plate 902 for attaching to a dependent loop 250. The attachment plate 902 includes nodules 904 disposed on opposing sides of the attachment plate. The nodules 904 correspond to holes 252 formed through the dependent loop 250. In operation, the accessory hanger 900 may be attached to the dependent loop 250 by inserting the accessory hanger 900 through the lower portion of the dependent loop 250. The accessory hanger may then be rotated toward the holes 252 and force may be applied to the attaching plate 902 in the appropriate direction to secure nodules 904 to holes 252.

Figure 16A:
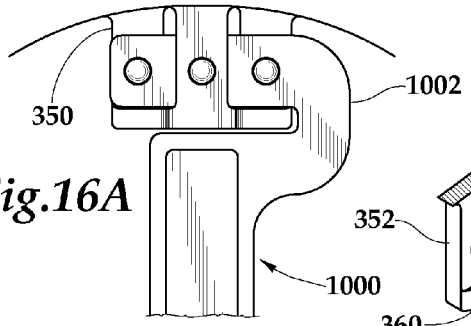
FIG. 16*a* is an elevational of an accessory hanger engaged with a dependent loop according to another embodiment of the present disclosure.
Figure 16C:
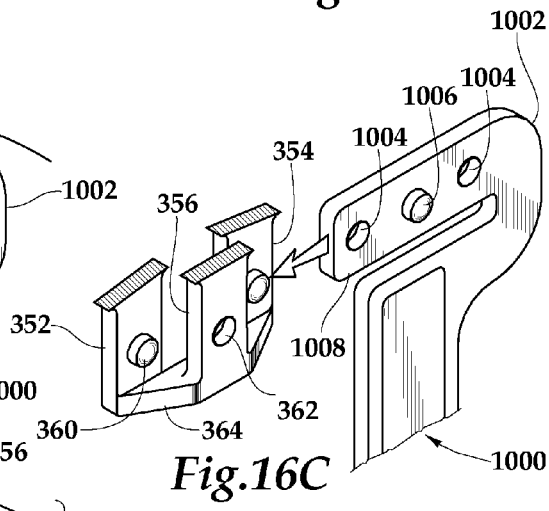
FIG. 16*c* is a perspective view of the accessory hanger of FIG. 16*a* separated from the dependent loop.
Figure 16B:
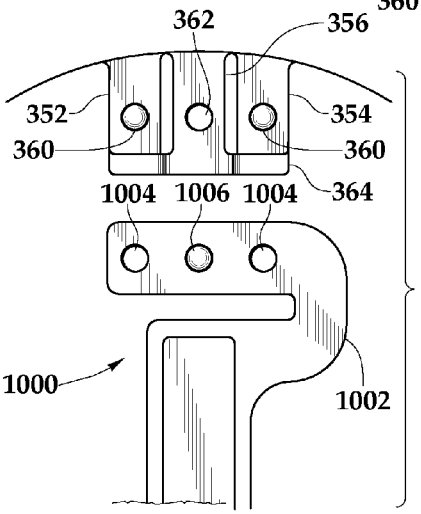
FIG. 16*b* is an elevational view of the accessory hanger of FIG. 16*a* separated from the dependent loop.

FIGS. 16*a*-16*c* illustrate yet another embodiment of the present disclosure in which an accessory hanger 1000 includes a hook portion 1002 for engagement with a dependent loop 350. In this embodiment, the dependent loop 350 includes three legs 352, 354, 356, of which legs 352 and 354 extend posteriorly (as viewed in FIGS. 16*a*-16*c*) of leg 356. As illustrated in FIGS. 16*b*-16*c*, the dependent loop 350 and hook portion 1002 include complimentary structure to provide a secured engagement therebetween. In particular, the hook portion 1002 includes a pair of holes 1004 formed through the hook portion and disposed substantially about a nodule 1006 extending from the hook portion. The dependent loop 350 includes a pair of nodules 360, at least one of each being disposed on legs 352 and 354, thereby providing an engagement structure for the corresponding holes 1004. In addition, the dependent loop includes a hole 362 formed through the leg 356 for receiving the corresponding nodule 1006 extending from the hook portion 1002. Of course, any combination of holes/nodules may be used to provide a secured engagement between the hook portion 1002 and the dependent loop 350. The hook portion 1002 further includes a slot 1008 for permitting access of the hook portion 1002 over a base portion 364 of the dependent loop 350. In practice, the hook portion 1002 is directed over the base portion 364 in the direction shown by the arrow in FIG. 16*c*. The hook portion 1002 is then engaged with the dependent loop 350 via the holes/nodules arrangement discussed above.

Figure 17A:
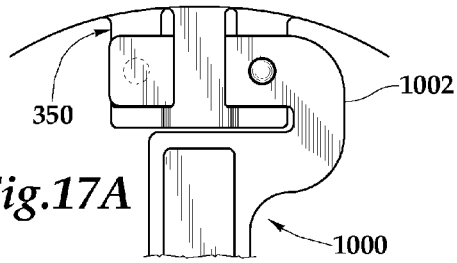
FIG. 17*a* is an elevational view of an accessory hanger engaged with a dependent loop according to another embodiment of the present disclosure.
Figure 17B:
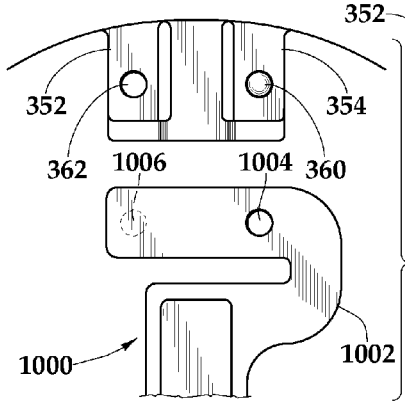
FIG. 17*b* is an elevational view of the accessory hanger of FIG. 17*a* separated from the dependent loop.
Figure 17C:
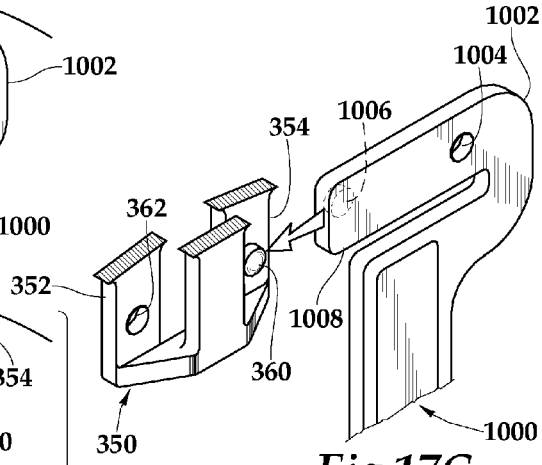
FIG. 17*c* is a perspective view of the accessory hanger of FIG. 17*a* separated from the dependent loop.

FIGS. 17*a*-17*c* illustrate yet another embodiment of the present disclosure in which the accessory hanger 1000 includes the hook portion 1002 for engagement with the dependent loop 350. In this embodiment, the accessory hanger 1000 and dependent loop 350 have alternate structure for providing the secure engagement therebetween. In particular, the accessory hanger 1000 has been modified to include a hole 1004 formed through the right side (as viewed in FIG. 17*b*) of the hook portion 1002 and a nodule 1006 disposed on a surface of the left side (as viewed in FIG. 17*b*) of the hook portion. The dependent loop 350 includes complimentary structure to receive the accessory hanger 1000 in a secure engagement. In particular, the dependent loop 350 includes a nodule 360 formed on leg 354 and a hole 362 formed through leg 352, thereby providing an engagement structure for the corresponding hole 1004 and nodule 1006. Of course, any combination of holes/nodules may be used to provide a securing engagement. The hook portion 1002 further includes a slot 1008 for permitting access of the hook portion 1002 over a base portion 364 of the dependent loop 350. In practice, the hook portion 1002 is directed over the base portion 364 in the direction shown by the arrow in FIG. 17*c*. The hook portion 1002 is then engaged with the dependent loop 350 via the holes/nodules arrangement discussed above.

Figure 18A:
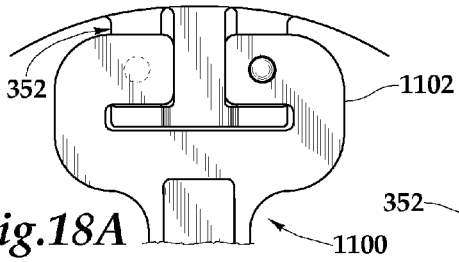
FIG. 18*a* is an elevational view of an accessory hanger engaged with a dependent loop according to another embodiment of the present disclosure.
Figure 18B:
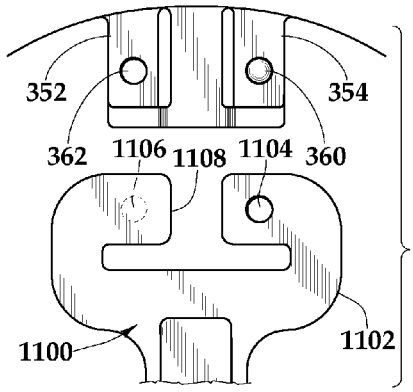
FIG. 18*b* is an elevational view of the accessory hanger of FIG. 18*a* separated from the dependent loop.
Figure 18C:
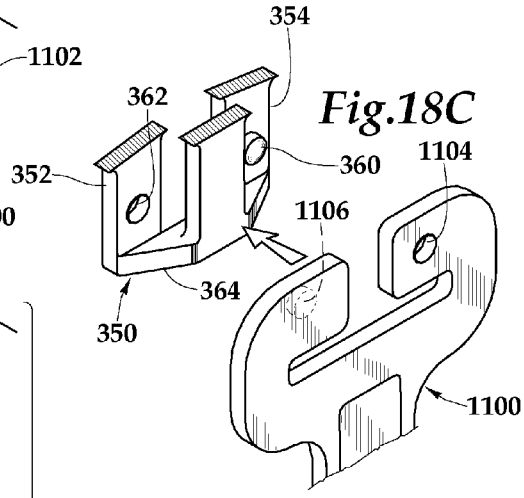
FIG. 18*c* is a perspective view of the accessory hanger of FIG. 18*a* separated from the dependent loop.

FIGS. 18*a*-18*c* illustrate yet another embodiment of the present disclosure in which an alternative accessory hanger 1100 may be engaged with the dependent loop 350. In this embodiment, the accessory hanger 1100 includes an attaching portion 1102 having an inverted T-slot 1108 formed therein. The attaching portion 1102 includes a hole 1104 formed through the right side (as viewed in FIG. 18*b*) of the attaching portion 1102 and a nodule 1106 disposed on a surface of the left side (as viewed in FIG. 18*b*) of the attaching portion. The dependent loop 350 includes a nodule 360 formed on leg 354 and a hole 362 formed through leg 352, thereby providing an engagement structure for the corresponding hole 1104 and nodule 1106. Of course, any combination of holes/nodules may be used to provide a securing engagement. In practice, the attaching portion 1102 is directed over the base portion 364 in the direction shown by the arrow in FIG. 18*c*. The attaching portion 1102 is then engaged with the dependent loop 350 via the holes/nodules arrangement discussed above.

Figures 19A, 19B, 19C:
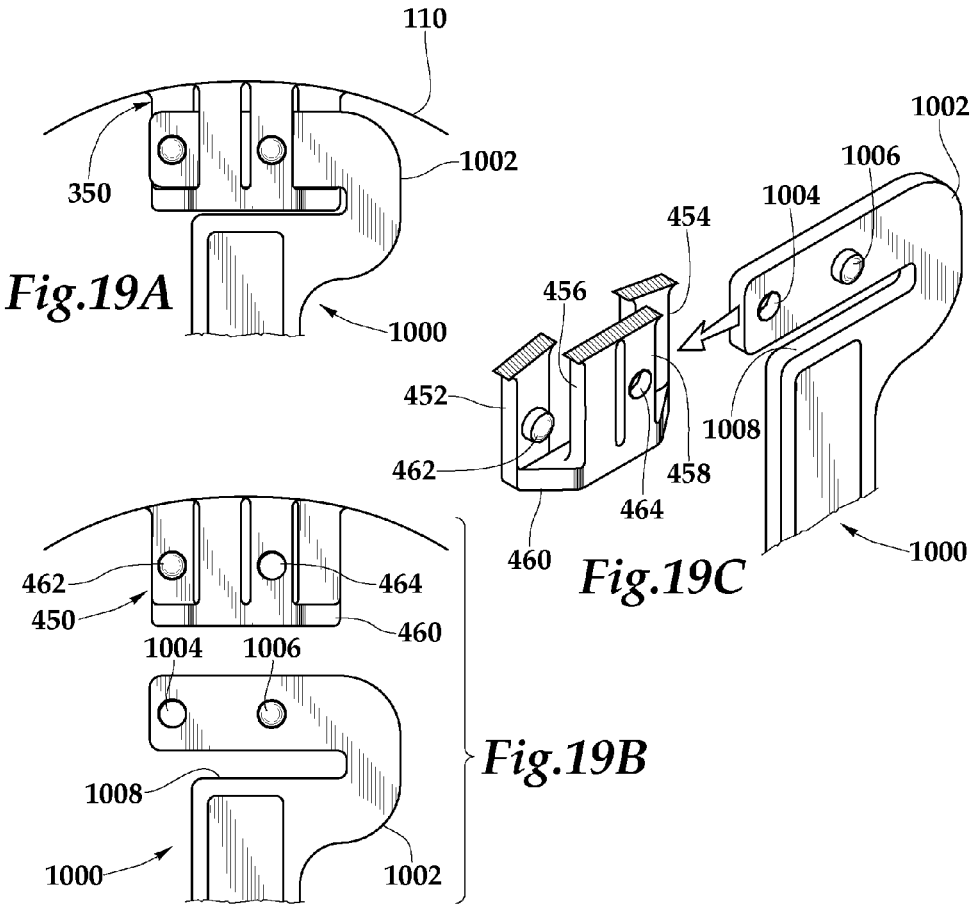
FIG. 19*a* is an elevational view of an accessory hanger engaged with a dependent loop according to another embodiment of the present disclosure.
FIG. 19*b* is an elevational view of the accessory hanger of FIG. 19*a* separated from the dependent loop.
FIG. 19*c* is a perspective view of the accessory hanger of FIG. 19*a* separated from the dependent loop.

FIGS. 19*a*-19*c* illustrate yet another embodiment of the present disclosure in which the accessory hanger 1000 may be engaged with an alternative dependent loop 450. In this embodiment, the dependent loop 450 includes four legs 452, 454, 456 and 458 extending from the cross member (not shown) and terminating in a base portion 460. The dependent loop 450 and hook portion 1002 include complimentary structure to provide a secured engagement therebetween. In particular, the hook portion 1002 includes a hole 1004 formed through the left side of the hook portion (as viewed in FIG. 19*b*) and a nodule 1006 extending from the hook portion and disposed right of the hole 1004 (as viewed in FIG. 19*b*). The dependent loop 450 includes a nodule 462 disposed on leg 452 and a hole 464 formed through leg 458, thereby providing an engagement structure for the corresponding hole and nodule of the hook portion 1002. Of course, any combination of holes/nodules may be used to provide a securing engagement. The hook portion 1002 further includes a slot 1008 for permitting access of the hook portion 1002 over the base portion 460 of the dependent loop 450. In practice, the hook portion 1002 is directed over the base portion 460 in the direction shown by the arrow in FIG. 19*c*. The hook portion 1002 is then engaged with the dependent loop 450 via the holes/nodules arrangement discussed above.

While various embodiments of a garment hanger with a dependent loop and associated accessory hangers according to the apparatus and principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A garment hanger operable to receive an attaching hanger, the attaching hanger having an attachment plate, the attachment plate having first and second openings defined therethrough, the garment hanger comprising:

a cross member; and a loop member depending downwardly from the cross member, the loop member cooperating with the cross member to form a closed loop;

wherein the loop member further comprises:

a first portion defining a first opposing surface lying in a first plane and having a first nodule extending therefrom;

a second portion defining a second opposing surface lying in a second plane and having a second nodule extending therefrom; and a third portion disposed between the first and second portions, the third portion connecting the first and second opposing surfaces, whereby the first and second opposing surfaces are spaced apart such that the first nodule extends towards the second plane and the second nodule extends towards the first plane;

wherein the first and second portions define first and second longitudinal axes, respectively, and the first and second longitudinal axes are not parallel, whereby the first and second nodules are operable to be received by the first and second openings of the attachment plate of the attaching hanger, respectively; and wherein the nodules each comprise a stem with a ball joint mounted on the stem.

2. A garment hanger according to claim 1, wherein a plurality of nodules are disposed on one surface of the loop member.

3. A garment hanger according to claim 1, further comprising an arm extending upwardly from the cross member towards a second cross member, wherein the first and second cross members are connected in a tandem arrangement.

4. A garment hanger according to claim 3, further comprising a second arm extending upwardly from the second cross member, the second arm having an attaching plate connected thereto.

5. A garment hanger according to claim 1, wherein the first and second planes are parallel to each other.

6. A method for mounting a first hanging apparatus to a second hanging apparatus, the method comprising:

providing a first hanging apparatus having a cross member and a loop depending downwardly from the cross member, wherein the loop defines a pair of opposing surfaces each having at least one hole formed therethrough;

providing a second hanging apparatus, the second hanging apparatus having an arm and an attaching plate connected to the arm, wherein the attaching plate includes a plurality of nodules disposed thereon, a centrally disposed opening, and a slot extending from the opening; and inserting the attaching plate over a portion of the loop via the slot, rotating the attaching plate to align the holes with the nodules, and exerting force on the attaching plate to secure the nodules to the holes.

7. A garment hanger operable to receive an attaching hanger, the attaching hanger having an attachment plate, the attachment plate having first and second openings defined therethrough, the garment hanger comprising:

a cross member; and a loop member depending downwardly from the cross member, the loop member cooperating with the cross member to form a closed loop;

wherein the loop member further comprises:

a first portion defining a first opposing surface lying in a first plane and having a first nodule extending therefrom;

a second portion defining a second opposing surface lying in a second plane and having a second nodule extending therefrom; and a third portion disposed between the first and second portions, the third portion connecting the first and second opposing surfaces, whereby the first and second opposing surfaces are spaced apart such that the first nodule extends towards the second plane and thesecond nodule extends towards the first plane;

wherein the first and second portions define first and second longitudinal axes, respectively, and the first and second longitudinal axes are not parallel, whereby the first and second nodules are operable to be received by the first and second openings of the attachment plate of the attaching hanger, respectively; and wherein the nodules each comprise a peg.

8. A garment hanger according to claim 7, wherein a plurality of nodules are disposed on one surface of the loop member.

9. A garment hanger according to claim 7, further comprising an arm extending upwardly from the cross member towards a second cross member, wherein the first and second cross members are connected in a tandem arrangement.

10. A garment hanger according to claim 9, further comprising a second arm extending upwardly from the second cross member, the second arm having an attaching plate connected thereto.

11. A garment hanger according to claim 7, wherein the first and second planes are parallel to each other.

12. A garment hanger, comprising:

a cross member; and a loop member depending downwardly from the cross member, the loop member cooperating with the cross member to form a closed loop;

wherein the loop member further comprises:

a first portion having proximal and distal ends and defining a first opposing surface therebetween lying in a first plane, wherein the first portion has a first nodule extending from the first opposing surface, and the proximal end of the first portion is directly connected to and thereby abuts the cross member;

a second portion having proximal and distal ends and defining a second opposing surface therebetween lying in a second plane, wherein the second portion has a second nodule extending from the second opposing surface, and the proximal end of the second portion is directly connected to and thereby abuts the cross member; and a third portion directly connected to the distal ends of the first and second portions, the third portion connecting the first and second opposing surfaces, whereby the first and second opposing surfaces are spaced apart such that the first nodule extends towards the second plane and the second nodule extends towards the first plane; and wherein the nodules each comprise a peg.

13. A garment hanger according to claim 12, wherein a plurality of nodules Previously presented are disposed on one surface of the loop member.

14. A garment hanger according to claim 13, further comprising an arm extending upwardly from the cross member towards a second cross member, wherein the first and second cross members are connected in a tandem arrangement.

15. A garment hanger according to claim 14, further comprising a second arm extending upwardly from the second cross member, the second arm having an attaching plate connected thereto.

16. A garment hanger according to claim 12, wherein the first and second planes are parallel to each other.

17. A garment hanger according to claim 16, wherein the first and second portions define first and second longitudinal axes, respectively, and the first and second longitudinal axes are not parallel.

18. A garment hanger, comprising:

a cross member; and a loop member depending downwardly from the cross member, the loop member cooperating with the cross member to form a closed loop;

wherein the loop member further comprises:

a first portion having proximal and distal ends and defining a first opposing surface therebetween lying in a first plane, wherein the first portion has a first nodule extending from the first opposing surface, and the proximal end of the first portion is directly connected to and thereby abuts the cross member;

a second portion having proximal and distal ends and defining a second opposing surface therebetween lying in a second plane, wherein the second portion has a second nodule extending from the second opposing surface, and the proximal end of the second portion is directly connected to and thereby abuts the cross member; and a third portion directly connected to the distal ends of the first and second portions, the third portion connecting the first and second opposing surfaces, whereby the first and second opposing surfaces are spaced apart such that the first nodule extends towards the second plane and the second nodule extends towards the first plane; and wherein the nodules each comprise a stem with a ball joint mounted on the stem.

19. A garment hanger according to claim 18, wherein the first and second planes are parallel to each other.

20. A garment hanger according to claim 19, wherein the first and second portions define first and second longitudinal axes, respectively, and the first and second longitudinal axes are not parallel.

* * * * *